US006579381B1

(12) United States Patent
Moscatelli

(10) Patent No.: US 6,579,381 B1
(45) Date of Patent: Jun. 17, 2003

(54) CLEANING COMPOSITION, METHOD FOR CLEANING A SILK SCREEN AND CLEANING DEVICE

(75) Inventor: Alexandre Moscatelli, Jonage (FR)

(73) Assignee: Chim 92, Meyzieu (FR)

( * ) Notice: Subject to any disclaimer, the term of this patent is extended or adjusted under 35 U.S.C. 154(b) by 0 days.

(21) Appl. No.: 09/868,321

(22) PCT Filed: Oct. 19, 2000

(86) PCT No.: PCT/FR00/02917

§ 371 (c)(1),
(2), (4) Date: Jul. 2, 2001

(87) PCT Pub. No.: WO01/29168

PCT Pub. Date: Apr. 26, 2001

(30) Foreign Application Priority Data

Oct. 19, 1999 (FR) ..... 99 13303
Oct. 19, 1999 (FR) ..... 99 13302
Nov. 26, 1999 (FR) ..... 99 14950

(51) Int. Cl.[7] ..... C11D 3/39
(52) U.S. Cl. ..... 134/28; 510/172; 510/176
(58) Field of Search ..... 134/28; 510/170, 510/172, 175, 176

(56) References Cited

U.S. PATENT DOCUMENTS 4,062,643 A * 12/1977 Boehmke et al. ..... 8/1 A
4,664,721 A * 5/1987 Valasek ..... 134/26
5,098,450 A * 3/1992 Patzelt et al. ..... 55/45
5,354,492 A 10/1994 Short
5,877,133 A * 3/1999 Good ..... 510/175
5,885,758 A 3/1999 Bertucci et al.
6,265,367 B1 * 7/2001 Callaghan et al. ..... 510/242
6,454,867 B1 * 9/2002 Bourdat ..... 134/1

FOREIGN PATENT DOCUMENTS

| | | |
|---|---|---|
| DE | 29 14 453 C2 | 10/1983 |
| EP | 0 111 708 A2 | 6/1984 |
| FR | 2 354 377 A | 1/1978 |
| GB | 1 586 471 A | 3/1981 |
| WO | WO 90/08603 | 8/1990 |
| WO | WO 96/24492 | 8/1996 |

OTHER PUBLICATIONS

"Die Neue Generation Der Perfecta–Automaten Zum Siebwaschen Und Entschichten", Esc Perfecta S, XX, XX, 1988, Full page XP002141030, whole document.

* cited by examiner

*Primary Examiner*—John Hardee
(74) *Attorney, Agent, or Firm*—Oliff & Berridge, PLC

(57) ABSTRACT

The invention concerns a cleaning composition comprising an aqueous solution containing between 0.05 to 5 wt. % of sodium metaperiodate and between 0.05 and 0.75 wt. % of sulfuric acid, and an aqueous solution of 0.5 to 90 wt. % of a mixture of dialkylesters and of 0.5 to 50 wt. % of a non-ionic surfactant. The method for cleaning a silk screen consists in exposing it to such a composition to eliminate ink, the masking product and the ghost image. The device for cleaning comprises a first section (4) wherein are a first ramp (26) of nozzles for spraying a cleaning composition on the screen (2) and a second ramp (32) of nozzles for spraying water under high pressure, and with which is associated a drain tank (20) for recovering the cleaning product and a reservoir (14) of cleaning product separate from the drain tank (20).

15 Claims, 2 Drawing Sheets

CLEANING COMPOSITION, METHOD FOR CLEANING A SILK SCREEN AND CLEANING DEVICE

Figure 1:
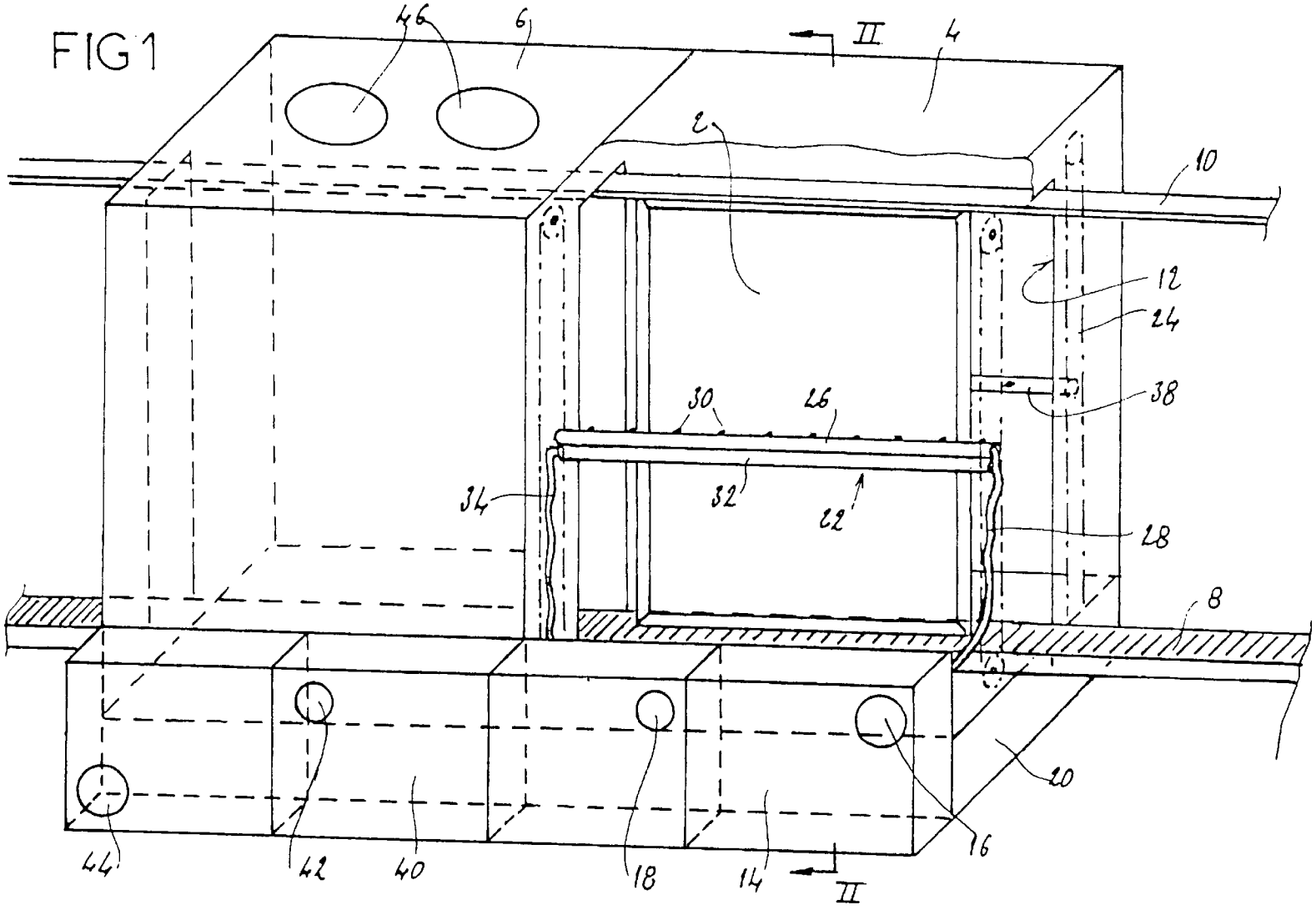

The present invention relates to the field of the maintenance of the screens used in printing, and more particularly in screen printing.

In screen printing, screens are used which consist of a frame in which a fabric is stretched, originally made of silk but nowadays more usually made of nylon/polyester, which has very fine mesh cells (of the order of 100 $\mu$m). A masking product, intended to fill some of the mesh cells of the fabric, is firstly applied to the screens and then ink is applied, which passes through the mesh cells which are left free and which correspond to the impression of the pattern to be reproduced on the printing medium.

For each new pattern to be printed using this technique, it is necessary to clean the screen, removing the ink and the masking product.

Conventionally, the screen is cleaned in three phases, which are as follows:

- in a first phase, the screen is treated with an organic solvent which allows the ink to be removed and then it is rinsed with high-pressure water in order to remove the solvent and the ink residues;
- in a second phase, an aqueous solution of an oxidizing agent, such as sodium periodate, called a degritting solution, is applied in order to make the masking product disappear from the obstructed mesh cells, and then a further rinsing with high-pressure water is carried out; and
- in a third phase, the ghost image remaining on the screen is removed by means of a chlorinated product and a final rinse with high-pressure water is carried out.

This cleaning is carried out either manually, or automatically in washing tunnels in which the steps take place in succession in different compartments.

The machines currently used for this cleaning have four compartments. Associated with each compartment is a tank designed to contain a product corresponding to the aforementioned phases.

In the first compartment there is a tank containing a solvent able to dissolve the inks used in screen printing. In this compartment, the screen is sprayed with the product found in the tank by nozzles which are mounted on a vertical spray bar. The vertical spray bar moves in a horizontal direction in order to spray the entire area of the screen. The sprayed product falls back into the tank, by gravity, with the ink.

The second compartment also has a tank containing solvent. The latter is also sprayed using a vertical spray bar which moves in a horizontal direction over the screen. This solvent is cleaner than that of the first tank. Solvent-recycling machines in the first and second tanks are provided in order to increase the lifetime of the product contained in these tanks.

Before the screen passes from the second to the third compartment, it is washed with high-pressure water.

The corresponding tank in the third compartment contains a degritting product allowing the masking product to be removed. This product is applied to the screen, also using nozzles placed on a vertical spray bar which moves horizontally.

In the final, fourth compartment, the screen is washed with high-pressure water.

The screen is then ready to undergo a new step, that of removing the ghost image.

While the screen is being cleaned, it is therefore out of commission for a period which may range up to one day, or even longer.

This is because, and by way of example to illustrate the loss of time devoted to cleaning a screen, the final phase consisting in removing the ghost image is carried out by applying, to both sides of the screen, a product based on chlorine and sodium hydroxide, which is left to act for at least half a day. After this reaction time, the screen is washed with a solvent, in order to remove the ink, masking product and chlorinated product residues, the solvent is left to react and then the screen is rinsed with high-pressure water. After the screen is dried, it is again available for the next use.

Another drawback with the cleaning of the screens is the very high level of pollution that they produce, since the effective solvents such as, for example, halogenated hydrocarbons are harmful and nonbiodegradable and, moreover, the residual mixture of water, solvents and ink that are collected cannot easily be recycled. In addition, these solvents are inflammable and handling them, especially in large quantities, is dangerous.

The problem of the complexity and the duration of the cleaning process has already been studied. Thus, according to document FR-A-2 354 377, a composition for cleaning a screen is known which allows both the ink and the masking product to be removed, this composition consisting of a mixture of an organic solvent, especially gamma-butyrolactone, N-methyl-2-pyrrolidone or dimethylformamide (DMF), an oxidizing agent such as sodium periodate, and optionally a surfactant.

However, the treatment of the screen by this composition is not completely satisfactory as a prior step of treating the screen with white spirit proves to be necessary in order to remove the surplus ink. Furthermore, this solution does not solve the problem of pollution by the residual organic solvents, and it may involve particularly toxic solvents such as DMF.

To limit the pollution caused by the cleaning compositions and their consequent effects on the environment, document WO-A-90/08603 provides a composition in which the organic solvents conventionally employed are replaced with a mixture of dibasic esters, such as dimethyl esters chosen from dimethyl succinate, adipate and glutarate, which is used in the presence of a surfactant. This ester mixture, which acts on the printing ink, is not toxic and is biodegradable. The preferred surfactant is nonionic, such as an ethoxylated aliphatic alcohol or an ethoxylated alkylphenol. One advantageous composition comprises 90–100% by weight of the aforementioned ester mixture and 10–0% by weight of an ethoxylated aliphatic alcohol.

However, this composition does not dissolve the masking product and its action must be supplemented in a conventional manner with a degritting step and then a step of treatment with a chlorinated product in order to remove the ghost image.

For want of a really effective solution, the screen cleaning processes have remained the same for many years, that is to say for at least thirty years, and have been widely employed in screen printing, despite their numerous drawbacks.

According to the invention, a cleaning composition has been developed which makes it possible to solve all the disadvantages encountered with the conventional cleaning methods, including the partial solutions of the prior art.

The invention provides a composition and a process for cleaning a screen-printing screen which are effective and result in a single step, in the removal of both the ink and the masking product. This composition is highly advantageous as it has a specific activity with respect to the products to be removed from the screen, but has no corrosive effect liable to damage the fabric or to result in its premature aging.

Furthermore, the cleaning according to the invention leaves no or virtually no ghost image behind so that the screen, after drying, can be reused immediately.

The benefit of the cleaning power of the composition is twofold. Firstly, and as indicated above, this power is exerted against all the products and residues to be removed from the mesh cells of the fabric, but, in addition, it is almost immediate, and therefore the period of decommissioning of the screen for the sake of cleaning is considerably reduced.

Despite its effectiveness, this composition is not polluting. It is highly advantageous as it is based on nontoxic products presenting no hazard either to the user or to the environment.

Thus, a first subject of the invention is a cleaning composition comprising:

an aqueous solution comprising from 0.05 to 5% by weight of sodium metaperiodate and from 0.05 to 0.75% by weight of sulfuric acid, and a solution containing from 0.5 to 90% by weight of a mixture of dialkyl esters and from 0.5 to 50% by weight of a nonionic surfactant.

The percentages mentioned in the present description and the claims are expressed by weight of constituents with respect to the weight of the solution when a solution as defined above is defined, or with respect to the final weight of the composition when the composition is defined, as will be revealed in the rest of the description.

Thus, the proportions of the various constituents of a composition of the invention are defined so as to obtain a composition tailored to the ink to be removed.

Advantageously, a composition as defined above furthermore comprises 1 to 15% by weight of periodic acid.

One particular composition of the invention comprises:

0.05 to 5% by weight of sodium metaperiodate, 0.05 to 0.75% by weight of sulfuric acid, 1 to 15% of periodic acid, 0.5 to 90% by weight of a mixture of dialkyl esters, and 0.5 to 50% by weight of a nonionic surfactant.

A composition of the invention furthermore satisfies the following characteristics, considered independently or in combination.

The mixture of dialkyl esters comprises or consists of a mixture of dialkyl glutarate, succinate and adipate; preferably, it is a mixture of dimethyl glutarate, succinate and adipate, the proportions of which are advantageously 61–67% in the case of the glutarate, 20–26% in the case of the succinate and 13–19% in the case of the adipate.

The nonionic surfactant is an ethoxylated alkylphenol and preferably ethoxylated nonylphenol.

One particularly appropriate composition comprises:

an aqueous solution containing from 0.1 to 0.5% by weight of sodium metaperiodate and from 0.1 to 0.5% by weight of sulfuric acid, an aqueous solution containing from 1 to 20% by weight of a mixture of dialkyl esters and from 1 to 22% by weight of a nonionic surfactant.

A further subject of the invention is a process for cleaning a screen-printing screen, in which the screen-printing screen is exposed to a composition like the one which has just been defined.

For this purpose, before the exposure step, the two aqueous solutions of said composition are mixed together.

Preferably, exposure of the screen to the composition is carried out by spraying (or vaporization), which technique will more particularly be employed if the cleaning is carried out in tunnels; it may also be carried out manually by application, for example, by means of a windowpane moistener.

After the exposure time, which may vary from one to five minutes, the screen is rinsed with water, preferably high-pressure water.

The subject of the invention is also the use of a composition as defined above for cleaning a screen used in screen printing.

Implementation of the process of the invention no longer requires voluminous installations, a single compartment being sufficient to expose the screen to the cleaning composition, in order to rinse it or even to dry it.

Thus, yet another subject of the invention is a machine for cleaning screens (2) used in screen printing, comprising at least a first compartment (4) in which there is a first spray bar (26) having nozzles intended to spray a cleaning composition onto the screen (2) and a second spray bar (32) having nozzles intended to spray high-pressure water, the said compartment (4) being associated with a tank (20) for recovering the cleaning product, said machine furthermore including a cleaning composition reservoir (14) separate from the recovery tank (20).

In this way, the product sprayed onto the screen to be cleaned is a clean product, which contains no diluted ink. This results in more effective cleaning and it is no longer necessary to provide two compartments for cleaning the screen. This structure also makes it possible to use the same tank to recover the degritting product.

The tank for recovering the cleaning composition is preferably fitted with a filtration system so as to comply with the legislation in force governing discharge into the drains. The filtration system will be designed to discharge only product having a COD of less than 2000.

In an advantageous embodiment, the first and second spray bars are placed beside each other so as to form only one unit.

Preferably, the spray bars are arranged horizontally. In this case, it will be preferable to choose to have moveable spray bars and a stationary screen during spraying. The spray bars then move advantageously upward and then downward in order to obtain good cleaning.

To complete the cleaning, the machine advantageously comprises motor-driven rotary brushes, the axes of which are approximately perpendicular to the plane of the screen.

In one embodiment, the spray bars can move with respect to a screen to be cleaned, which remains stationary while the cleaning composition and the water are being sprayed, as already mentioned above. However, it would be possible to have a moveable screen and stationary spray bars. In this case, the spray bars would preferably be vertical.

To allow better cleaning, the machine advantageously comprises a second double spray bar placed in such a way that the screen to be cleaned is located between the two double spray bars and can be sprayed on both its sides.

Advantageously, the machine comprises two metering devices, one taking off a predetermined quantity of a solution of sodium metaperiodate and sulfuric acid, the other taking off a predetermined quantity of a solution of a mixture of dialkyl esters and a nonionic surfactant, said metering devices being fitted with a water feed. Within one of the metering devices an aqueous solution of sodium metaperiodate and sulfuric acid will be obtained, and within the other metering device an aqueous solution of a mixture of dialkyl esters and a nonionic surfactant will be obtained. The products taken off are stored in reservoirs placed inside or outside the machine. The metering devices are hydraulic or electric.

In order also to allow any ghost images to be removed, the machine advantageously comprises a second compartment provided with spray means which can move with respect to the screen. These moveable spray means comprise, for example, a double spray bar, one spray bar being intended to spray a product for removing ghost images and the other spray bar for spraying high-pressure water.

In order to allow the product for removing the ghost images to be rapidly dried, the second compartment is advantageously provided with a forced-air system for driving hot air into the second compartment. To further improve the drying, the second compartment may be provided with a bar, which can move with respect to the screen, allowing hot air to be blown onto the screen. Even better drying is achieved when the first compartment includes a bar which can move with respect to the screen, this bar being a vacuum bar intended to initiate drying of the screen.

To avoid the appearance of streaks on the screen after it has passed through the machine according to the invention, means are advantageously provided for making the screen oscillate. In this way, during the operations relating to rinsing and drying of the screen, a better distribution of the stream over the screen is obtained, thereby preventing the appearance of streaks corresponding to the spray boundaries between two adjacent nozzles.

The invention also relates to a kit for cleaning and degritting a screen used in screen printing, this kit comprising a first chamber containing a solution, optionally an aqueous solution, of an ethoxylated alkylphenol and of dialkyl esters and a second chamber containing an aqueous solution of sodium metaperiodate and sulfuric acid.

Figure 2:
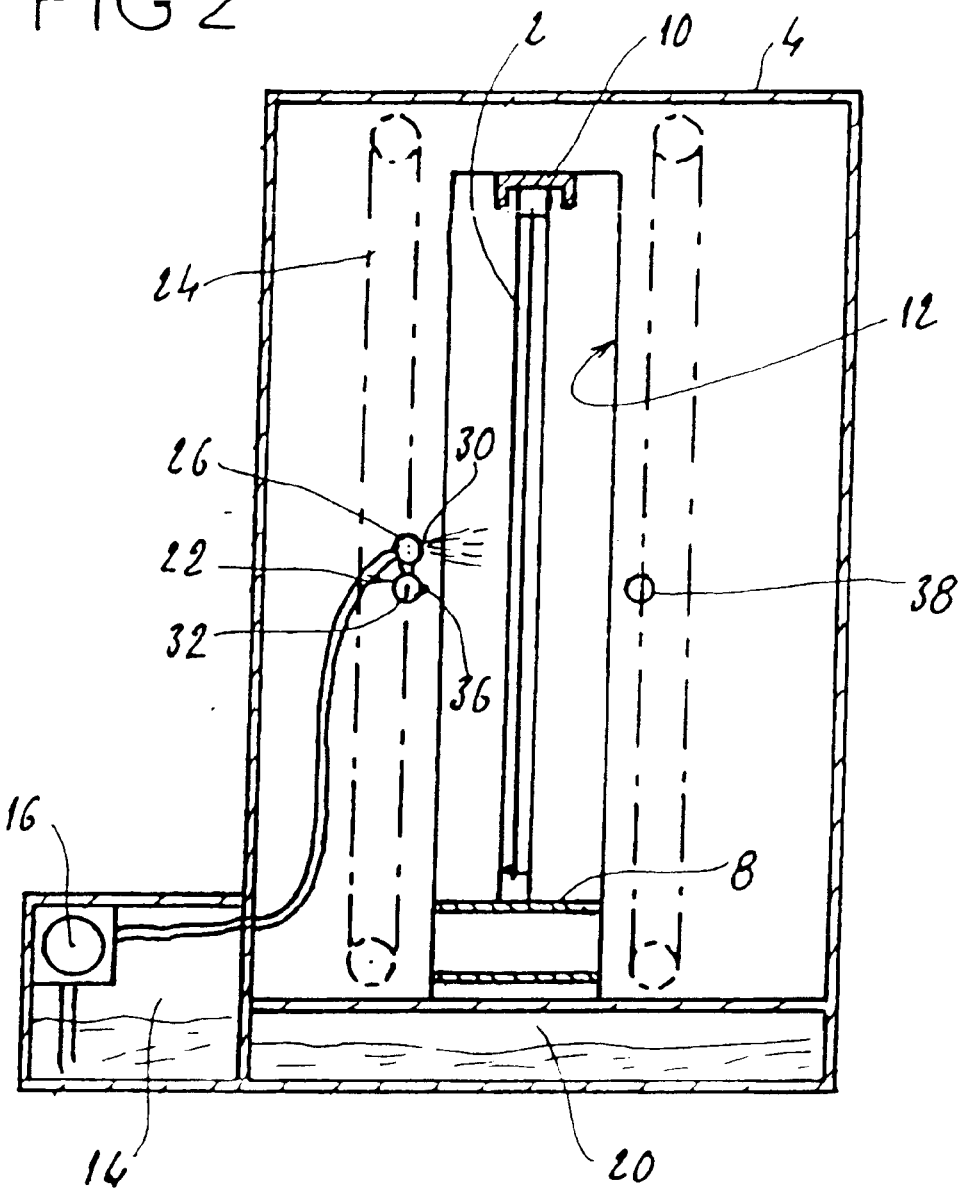

In any case, the invention will be more clearly understood with the aid of the description which follows, giving an example of a preferred composition of the invention, and then with reference to the appended schematic drawing showing, by way of nonlimiting example, a preferred embodiment of a machine according to the invention, in which:

FIG. 1 is a partially exploded perspective view of a machine according to the invention, and FIG. 2 is a cross-sectional view on the line of cutting II—II in FIG. 1.

In a preferred embodiment, an aqueous composition intended for cleaning a screen used in screen printing is obtained as follows:

firstly, 20% by weight of an ethoxylated alkylphenol is placed in a container, next, 13% of a commercially available mixture of dimethyl esters is added, all of the above is dissolved in 66.4% of water, 0.25% of sulfuric acid is added, and 0.25% by weight of sodium metaperiodate is added.

The composition thus obtained allows a screen-printing screen to be cleaned by removing both the inks deposited on this screen and the masking emulsions which are found therein.

It is generally unnecessary to use a product to remove the ghost image after use of the cleaning composition described above. Of course, the proportions indicated above may vary according to the inks and emulsions used.

The composition thus obtained is noninflammable. Its pH is slightly acid (between 5.5 and 6). It is not harmful and it meets the European standards in terms of biodegradability which define the minimum threshold for 90% biodegradability.

The cleaning composition described above can be easily filtered after use. Thus, after filtering, the water can be recovered and reused for the high-pressure rinsing.

A machine allowing the process of the invention to be implemented is described below with reference to the figures presented above.

FIG. 1 shows a cleaning machine capable of removing the ink, of degritting and of removing ghost images from a screen 2 used in screen printing. It comprises a first compartment 4 and a second compartment 6. Each compartment is in the form of a box. The dimensions of the overall machine are adapted to the dimensions of the screens to be cleaned.

A conveyor is used to introduce a screen 2 into the first compartment and then to make it pass into the second compartment. This conveyor has a motor-driven transfer chain 8 and an upper guide 10. The screen 2 is laid on the chain and is held in the vertical position by the upper guide 10. An opening 12 made in an external wall of the first compartment 4 allows the screen 2 to be put onto the conveyor.

Associated with the first compartment is a reservoir 14 intended to contain a cleaning solution, a pump 16 for pumping the product placed in this reservoir 14, a high-pressure pump 18 for pumping water, a drain tank 20, a double spray bar 22 with nozzles and a chain system 24 allowing the double spray bar 22 to move.

The reservoir 14 is intended to contain a composition of the invention. The pump 16 is used to pump the composition contained in the reservoir 14 into the double spray bar 22. This double spray bar 22 is placed horizontally. It is formed from two horizontal parallel spray bars, one beside the other. A first spray bar 26 is connected to the pump 16 via a hose 28. This first spray bar 26 is fitted with small nozzles 30 serving to spray the product contained in the reservoir 14. The spray pressure is, for example, between 2 and 4 bar.

The second spray bar 32 of the double spray bar 22 is connected to the high-pressure pump 18 via a hose 34. This second spray bar 32 is fitted with larger nozzles 36 allowing water at a pressure of about 120 bar to be sprayed.

The double spray bar 22 is placed horizontally. The chain system 24 allows this double spray bar 22 to move upward and then downward by motorized means. The double spray bar 22 is fixed near each of its ends to a chain which is itself mounted around two pulleys, one of which is driven by a motor. Such a system is known to those skilled in the art and is not described in detail in the present description. Any other system allowing the double spray bar to be moved may also be suitable.

On the other side of the screen 2 is a single vacuum drying bar 38. This bar 38 also runs horizontally and can move upward and then downward with the aid of two chain systems 24 as described above.

Beneath the screen 2 and the endless belt 8 is the drain tank 20. This tank is designed to recover the product and the water falling, under gravity, after having being sprayed by one of the spray bars of the double spray bar 22. This drain tank is connected to the drains or to a filtration system. If the composition indicated above is used, it is possible to connect this tank 20 directly to the drains since the composition is biodegradable. However, to save water it is also possible to connect the drain tank to a filtration system so as to recycle the water. Thus, the high-pressure pump 18 may be fed directly with water via a water supply mains or it can be fed with water through recycled water. The filtration system has not been shown in the drawing but it could, of course, be incorporated into this machine.

When it is provided, the second compartment 6 has a structure very close to that of the first compartment. In this second compartment 6, there is again a reservoir 40, a pump 42 associated with this reservoir, a high-pressure pump 44 intended to pump water, and a drain tank (not shown). Also again on one side of the conveyor belt 8, which also runs through the second compartment, is a double spray bar mounted on two chain systems, like the chain systems 24. On the other side of the conveyor belt 8 there is also a single bar mounted on two chain systems. For the sake of clarity, this double spray bar and this single bar have not been shown in the drawing.

The reservoir 40 contains a product known to those skilled in the art, allowing the ghost images on a screen-printing screen to be removed. This product is a chlorinated gel. The pump 42 is used to send, via a hose (not shown), the product contained in the reservoir 40 into one spray bar of the corresponding double spray bar. The product allowing a ghost image to be removed is then sprayed by nozzles at a pressure of about 2 bar. The high-pressure pump 44 is itself connected to the other spray bar of the double spray bar of the second compartment via another hose. This spray bar also has nozzles intended to spray water at a pressure of about 120 bar.

The single bar, unlike the single bar of the first component 4, is provided with nozzles for blowing hot air. A fan and a resistance heating element (which are not shown in the drawing) allow air at approximately 30° to be sent into this bar from which it is blown toward the screen.

The drain tank collects the products which drop off the screen 2 by gravitation. In addition to the hot-air blowing bar, a forced-air system 46 is provided in the second compartment.

The operation of this machine is therefore as follows.

The screen 2 is conveyed automatically by the belt 8 and by means of the upper guide 10 inside the first compartment 4. The double spray bar 22 is in the low position. Once the screen 2 is in place, the first spray bar 26 is supplied by the pump 16 with the composition of the invention. The double spray bar then starts to move upward. Once it has reached the top of the screen 2, it moves downward, continuing to spray the composition. The excess product, mixed with ink and the masking product, then drops down into the drain tank 20. After having allowed the product to act for a few seconds, or for a few tens of seconds, on the screen 2, the second spray bar 32 of the double spray bar 22 is supplied with water by the high-pressure pump 18. The double spray bar 22 then again moves upward until it reaches the top of the screen 2, and then moves downward until resuming its initial position. Thus, the screen is thoroughly rinsed. The rinsing water, with which the composition, the inks and the masking product are mixed, then collects in the drain tank 20.

The screen 2 is predried by means of the vacuum bar 38. This bar is also moved upward from its initial position at the bottom of the screen 2 as far as the top of the screen 2, and then back to its initial position. Thus, any excess water is removed from the screen 2. Preferably, the screen 2 oscillates horizontally from left to right in order to avoid forming vertical streaks. A cam system (not shown) allows this movement. The amplitude of the oscillations is, for example, a few centimeters.

Once the vacuum bar 38 has returned to its initial position, the screen 2 is conveyed into the second compartment 6. Product for removing the ghost images is then sprayed by the nozzles of a spray bar of the double spray bar of this compartment. The pump 42 sends the product into this spray bar. The latter moves from the bottom up and then from the top down so as to spray the product over the entire surface of the screen. The forced-air system 46 is then switched on. It blows air inside the compartment so as to try to keep the latter at a temperature of about 30°. A dehumidifier (not shown) may be combined with the forced-air system 46 so that the latter sends dry air into the second compartment 6. During this period, the single hot-air-blowing bar moves from the bottom up and then from the top down so as to blow hot air over the entire screen 2 and thoroughly dry the product designed to remove any ghost image. Several up-and-down passes of the blowing bar may be provided. The product allowing the ghost image to be removed acts when it is dry. Once this product is really dry and has acted, the double spray bar of the second compartment 4 is then supplied with high-pressure water by the high-pressure pump 44. The spray bar then moves from the bottom up and then from the top down, each time spraying water over the entire surface of the screen 2. The sprayed water and the product intended to remove the ghost images then drop down into the drain tank of the second compartment 6.

To prevent vertical streaks being formed on the screen 2, provision may also be made in the second compartment for the screen 2 to be oscillated in the horizontal direction. Here too, an oscillation having an amplitude of a few centimeters is sufficient.

Once the screen has been rinsed, it is conveyed automatically out of the second compartment 6 and out of the machine described above. It can then be received manually or else it is also possible to imagine an automatic screen-receiving tray at the outlet of this second compartment 6. Likewise, it is possible to have an automatic screen feeder at the inlet of the first compartment 4.

As goes without saying, the invention is not limited to the preferred embodiment described above by way of nonlimiting example, rather it encompasses any variant thereof within the scope of the claims hereinafter.

Thus, for example, instead of having a single reservoir for the composition in the first compartment, it would be possible to have two separate reservoirs, one of them containing an aqueous solution comprising from 0.05 to 5% by weight of sodium metaperiodate and from 0.05 to 0.75% by weight of sulfuric acid, and the other containing an aqueous solution comprising from 0.5 to 90% by weight of a mixture of dialkyl esters and from 0.5 to 50% by weight of a nonionic surfactant. The same spray bar could spray both these products simultaneously.

The fact that the spray bars move up and down is a preferred embodiment. A vertical spray bar moving horizontally may also be envisioned.

The fact of providing a double (composition+water) spray bar is optional, since it would be possible to have two separate spray bars.

Cleaning a screen according to the process according to the invention does not generally cause a ghost image to appear. In most cases, it is therefore unnecessary to have a second compartment.

The vacuum and blowing bars are optional. Consequently, the systems allowing these bars to oscillate are themselves also optional.

Any other system of conveying, feeding and discharging screens may, of course, be suitable in the present invention.

What is claimed is:

1. Process for cleaning a screen-printing screen, in which the screen is exposed to a cleaning composition, characterized in that, by applying the cleaning composition, the inks and the masking emulsions are removed in a single step, and then the screen is rinsed with water, characterized in that the composition comprises:

an aqueous solution comprising from 0.05 to 5% by weight of sodium metaperiodate and from 0.05 to 0.75% by weight of sulfuric acid, and a solution comprising from 0.5 to 90% by weight of a mixture of dialkyl esters and from 0.5 to 50% by weight of a nonionic surfactant.

2. Process according to claim 1, characterized in that, by removing the inks and the masking emulsions, the ghost images are also removed.

3. Process according to claim 1, characterized in that the screen is exposed to the composition by spraying or by manual application of the composition, for example by means of a windowpane moistener.

4. Process according to claim 1, characterized in that, before the exposure step, the two aqueous solutions of said composition are mixed together.

5. Cleaning composition, characterized in that it comprises:

an aqueous solution comprising from 0.05 to 5% by weight of sodium metaperiodate and from 0.05 to 0.75% by weight of sulfuric acid, and a solution containing from 0.5 to 90% by weight of a mixture of dialkyl esters and from 0.5 to 50% by weight of a nonionic surfactant.

6. Composition according to claim 5, characterized in that it comprises:

an aqueous solution containing from 0.1 to 0.5% by weight of sodium metaperiodate and from 0.1 to 0.5% by weight of sulfuric acid, and an aqueous solution containing from 1 to 20% by weight of a mixture of dialkyl esters and from 1 to 22% by weight of a nonionic surfactant.

7. Composition according to claim 5, characterized in that it furthermore comprises 1 to 15% by weight of periodic acid.

8. Composition according to claim 5, characterized in that it comprises:

0.05 to 5% by weight of sodium metaperiodate, 0.05 to 0.75% by weight of sulfuric acid, 1 to 15% of periodic acid, 0.5 to 90% by weight of a mixture of dialkyl esters, and 0.5 to 50% by weight of a nonionic surfactant.

9. Composition according to claim 5, characterized in that the mixture of dialkyl esters comprises or consists of a mixture of dialkyl glutarate, succinate and adipate.

10. Composition according to claim 9, characterized in that the mixture of dialkyl esters comprises or consists of a mixture of dimethyl glutarate, succinate and adipate.

11. Composition according to claim 10, characterized in that the mixture comprises or consists of a mixture of 61–67% dimethyl glutarate, 20–26% dimethyl succinate and 13–19% dimethyl adipate.

12. Composition according to claim 5, characterized in that the nonionic surfactant is an ethoxylated alkylphenol.

13. Composition according to claim 12, characterized in that the ethoxylated alkylphenol is ethoxylated nonylphenol.

14. Composition according to claim 12, characterized in that the ethoxylated alkylphenol is ethoxylated nonylphenol.

15. Kit for cleaning a screen-printing screen, characterized in that it comprises a first cavity containing an aqueous solution comprising from 0.05 to 5% by weight of sodium metaperiodate and from 0.05 to 0.75% by weight of sulfuric acid, and a second cavity containing a solution comprising from 0.5 to 90% by weight of a mixture of dialkyl esters and from 0.5 to 50% by weight of, nonionic surfactant.

* * * * *